US007447470B2

(12) United States Patent
Lee

(10) Patent No.: US 7,447,470 B2
(45) Date of Patent: Nov. 4, 2008

(54) TONER CARTRIDGE HAVING SLIDING SHUTTERS AND ELECTROPHOTOGRAPHIC IMAGE FORMING APPARATUS

(75) Inventor: Seung-yoon Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 61 days.

(21) Appl. No.: 11/448,674

(22) Filed: Jun. 8, 2006

(65) Prior Publication Data

US 2006/0285885 A1 Dec. 21, 2006

(30) Foreign Application Priority Data

Jun. 20, 2005 (KR) ..... 10-2005-0053073

(51) Int. Cl.
*G03G 15/08* (2006.01)

(52) U.S. Cl. ..... 399/262

(58) Field of Classification Search ..... 399/262, 399/260, 258

See application file for complete search history.

(56) References Cited

U.S. PATENT DOCUMENTS

| | | | | | |
|---|---|---|---|---|---|
| 4,963,940 | A | * | 10/1990 | Nemoto et al. | 399/262 |
| 5,091,750 | A | * | 2/1992 | Yoshida et al. | 399/106 |
| 5,111,976 | A | * | 5/1992 | Ban | 222/485 |
| 5,294,963 | A | * | 3/1994 | Nakano et al. | 399/106 |

FOREIGN PATENT DOCUMENTS

| | | | | |
|---|---|---|---|---|
| JP | 05035094 | A | * | 2/1993 |
| JP | 05-216344 | | | 8/1993 |
| JP | 6-149048 | | | 5/1994 |
| JP | 07-225514 | | | 8/1995 |
| JP | 7-225514 | | | 8/1995 |
| JP | 2000221766 | A | * | 8/2000 |
| JP | 2002-174947 | | | 6/2002 |
| KR | 10-0227914 | | | 8/1999 |

* cited by examiner

*Primary Examiner*—Quana M Grainger
(74) *Attorney, Agent, or Firm*—Roylance, Abrams, Berdo & Goodman, L.L.P.

(57) ABSTRACT

A toner cartridge and an electrophotographic image forming apparatus using the same are provided. The toner cartridge includes: a toner bottle air-tightly storing a toner; a first shutter sliding in a longitudinal direction of the toner bottle; and a second shutter sliding in a circumferential direction of the toner bottle to open and close a toner outlet.

20 Claims, 8 Drawing Sheets

TONER CARTRIDGE HAVING SLIDING SHUTTERS AND ELECTROPHOTOGRAPHIC IMAGE FORMING APPARATUS

CROSS-REFERENCE TO RELATED PATENT APPLICATION

This application claims the benefit of Korean Patent Application No. 10-2005-0053073, filed on Jun, 20, 2005, in the Korean Intellectual Property Office, the disclosure of which is hereby incorporated by reference in its entirety.

BACKGROUND OF THE INVENTION

1. Field of the Invention

The present invention relates to a toner cartridge and to an electrophotographic image forming apparatus. More particularly, the invention is directed to a toner cartridge detachably installed in a developing cartridge. The invention is also directed to an electrophotographic image forming apparatus using the toner cartridge of the invention.

2. Description of the Related Art

In general, in an electrophotographic image forming apparatus, light is illuminated onto a uniformly charged photosensitive medium to form an electrostatic latent image corresponding to a desired image. The electrostatic latent image is developed using a toner to form a toner image. The developed image is thereafter transferred and fixed onto paper to form the desired image.

In particular, colors of yellow Y, magenta M, cyan C, and black K are used in a color image forming apparatus that are overlapped to form a desired color image. The color image forming apparatus, therefore, requires four developers in which toners of the four colors are respectively stored.

The color image forming apparatus including the four developers has not only a larger volume but also a more complex configuration than a monochrome image forming apparatus forming a single color image.

The developer can be classified into a method in which the developer itself is replaced when a toner stored in the developers is used up and a method in which a developing cartridge having a developing roller and a toner cartage storing the toner are separate so that only the spent toner cartridge is replaced when the toner is used up.

When the toner is used up, one method replaces the developer and another method separates the developing cartridge including a developing roller from a toner cartridge for storing the toner and then replaces only the toner cartridge.

When replacing only the toner cartridge, the toner falls by gravity from the toner cartridge into the developing cartridge due to the weight of the toner. The toner cartridge includes a toner outlet for the toner and a shutter which opens and closes the toner outlet. The shutter opens and closes the toner outlet when the toner cartridge is attached to or detached from the developing cartridge.

Since the toner cartridge is separated from the developing cartridge, the toner remaining in the toner outlet may leak to the outside, thereby contaminating the image forming apparatus. In addition, the toner adhered to the shutter may stain a user's hand or clothes.

Therefore, a method is needed for preventing the toner from leaking from the toner cartridge when the toner cartridge is replaced.

SUMMARY OF THE INVENTION

The present invention provides a toner cartridge including a double shutter to prevent a toner from leaking to the outside when the toner cartridge is replaced. The invention is also directed to an electrophotographic image forming apparatus using the toner cartridge of the invention.

According to an aspect of the present invention, a toner cartridge comprises: an air-tight toner bottle for storing a toner and having a toner outlet; a first shutter sliding in a longitudinal direction of the toner bottle; and a second shutter sliding in a circumferential direction of the toner bottle to open and close the toner outlet.

These and other aspects of the invention will become apparent from the following detailed description of the invention which, in conjunction with the annexed drawings, disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
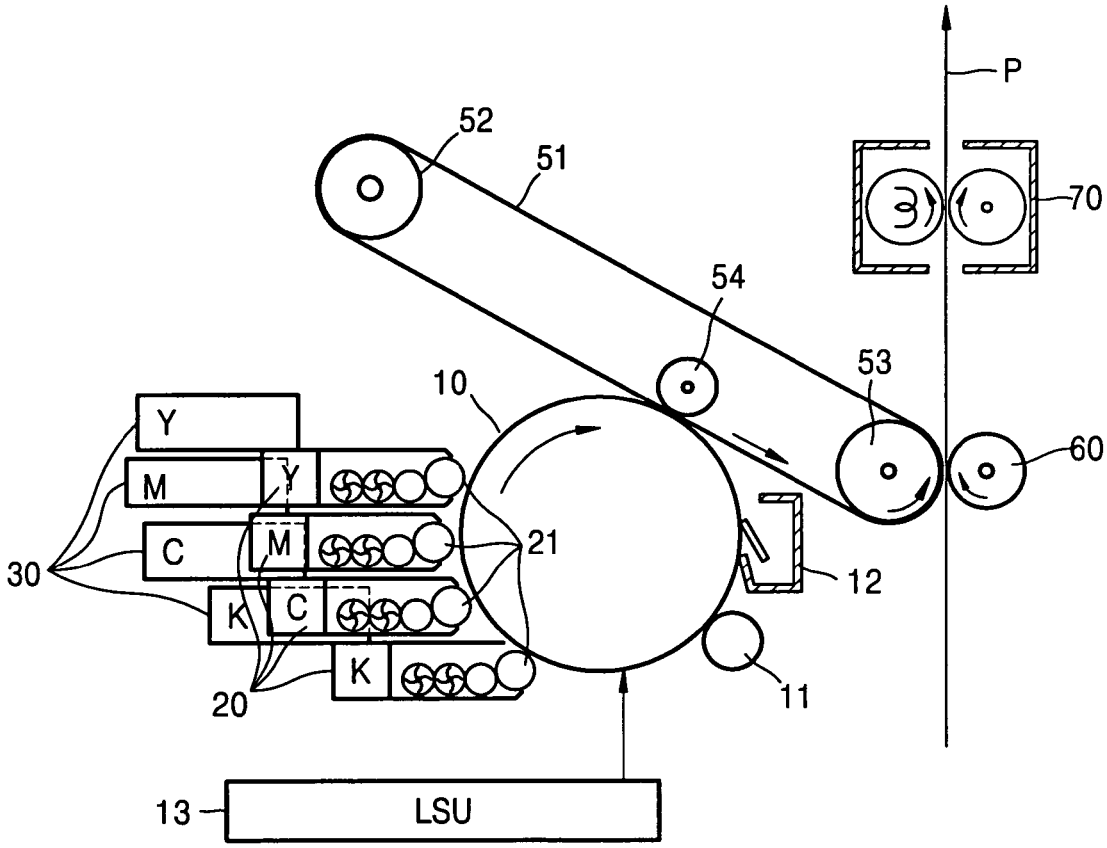
FIG. 1 is a schematic view of an electrophotographic image forming apparatus using a toner cartridge according to an embodiment of the present invention.

Referring to FIG. 1, an image forming apparatus includes a photosensitive drum 10, a plurality of developing cartridges 20, a plurality of toner cartridges 30, an intermediary transfer belt 51, a first transfer roller 54, a second transfer roller 60, and a fuser 70.

Referring to FIG. 1, in the photosensitive drum 10, a photoconductive layer is formed on the outer circumference of a metal drum having a cylindrical shape. Instead of the photosensitive drum 10, a photosensitive belt may be used in other embodiments. A charge roller 11 is an example of a charger which is placed near the outer circumference of the photosensitive drum 10 to equipotentailly charge the photosensitive drum 10. In addition, a cleaning element 12 is provided for removing toner remaining on the photosensitive drum 10 after a transfer thereof.

The charge roller 11 rotates while either contacting or not contacting the outer circumference surface of the photosensitive drum 10 to supply electric charges so that the outer circumference surface of the photosensitive drum 10 is equipotentailly charged. Instead of the charge roller 11, a corona charger may be used.

An exposure unit 13 illuminates light corresponding to image data onto the equipotentailly charged photosensitive drum 10 to form an electrostatic latent image. A laser scanning unit (LSU) that uses a laser diode as a light source is generally used as the exposure unit 13.

Figure 2:
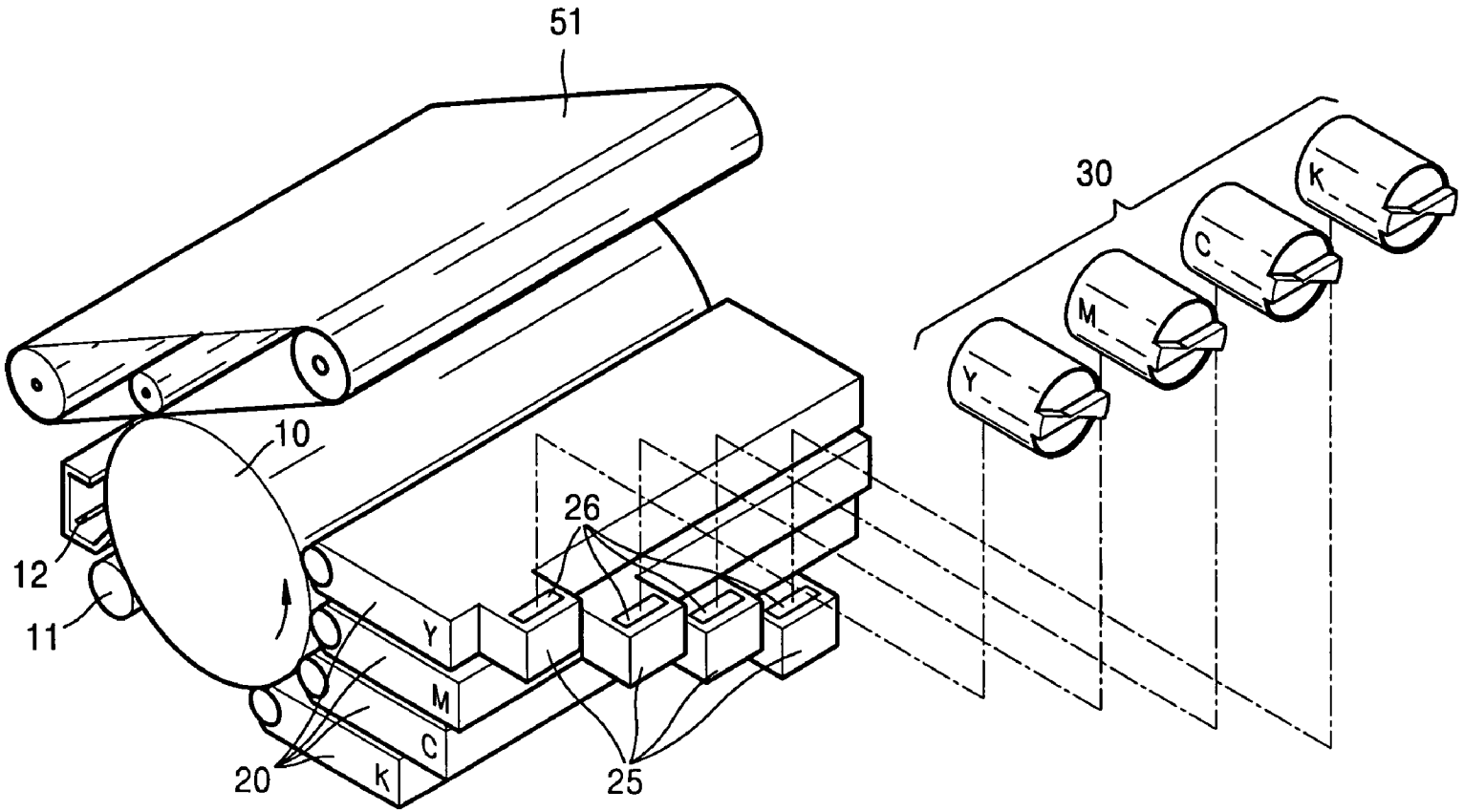
FIG. 2 is a perspective view illustrating a layout of a toner supply unit of a plurality of developing cartridges shown in FIG. 1.

As shown in FIG. 2, a plurality of toner cartridges 30Y, 30M, 30C, and 30K contain toners of yellow Y, magenta M, cyan C, and black K, respectively. The plurality of developing cartridges 20Y, 20M, 20C, and 20K receive the toners of the respective corresponding color from the plurality of toner cartridges 30Y, 30M, 30C, and 30K in order to develop the electrostatic latent image formed on the photosensitive drum 10.

The developing cartridges 20 include a development roller 21 separated from the photosensitive drum 10 by a development gap. The development gap between the roller 21 and the drum 10 is preferably tens or hundreds of microns.

Each of the image forming apparatus according to the present invention functions in a multi-pass process in which the plurality of developing cartridges 20Y, 20M, 20C, and 20K sequentially operate to form an image. In the multi-pass process, a development bias is applied to the development roller 21K of the selected developing cartridge 20K. The development bias may not be applied or an anti-development bias for preventing toner development may be applied to the development rollers 21K, 21M, and 21C of each of the other developing cartridges 20Y, 20M and 20C. In addition, only the development roller 21K of the selected developing cartridge 20K may rotate, and the development rollers 21Y, 21M, and 21C of the other developing cartridges 20Y, 20M and 20C may not rotate.

As shown in FIG. 2, the plurality of developing cartridges 20Y, 20M, 20C, and 20K are disposed in parallel with a main driving direction of the photosensitive drum 10. Toner supply units 25 of the plurality of developing cartridges 20Y, 20M, 20C, and 20K are misaligned with each other, so that the plurality of toner cartridges 30Y, 30M, 30C, and 30K can be disposed without obstructing each other.

At least a portion of the three developing cartridges 20M, 20C, and 20K positioned at the lower side shares a height occupied by the developing cartridges 20Y, 20M, and 20C positioned at the upper side, to minimize an increase of the height of the image forming apparatus caused by the plurality of toner cartridges 30Y, 30M, 30C, and 30K.

In addition, when the plurality of toner cartridges 30Y, 30M, 30C, and 30K are detached from the developing cartridges 20Y, 20M, 20C, and 20K, they can be disposed in a manner to avoid obstruction with the plurality of developing cartridges 20Y, 20M, 20C, and 20K or between the plurality of toner cartridges 30Y, 30M, 30C, and 30K.

Figure 3:
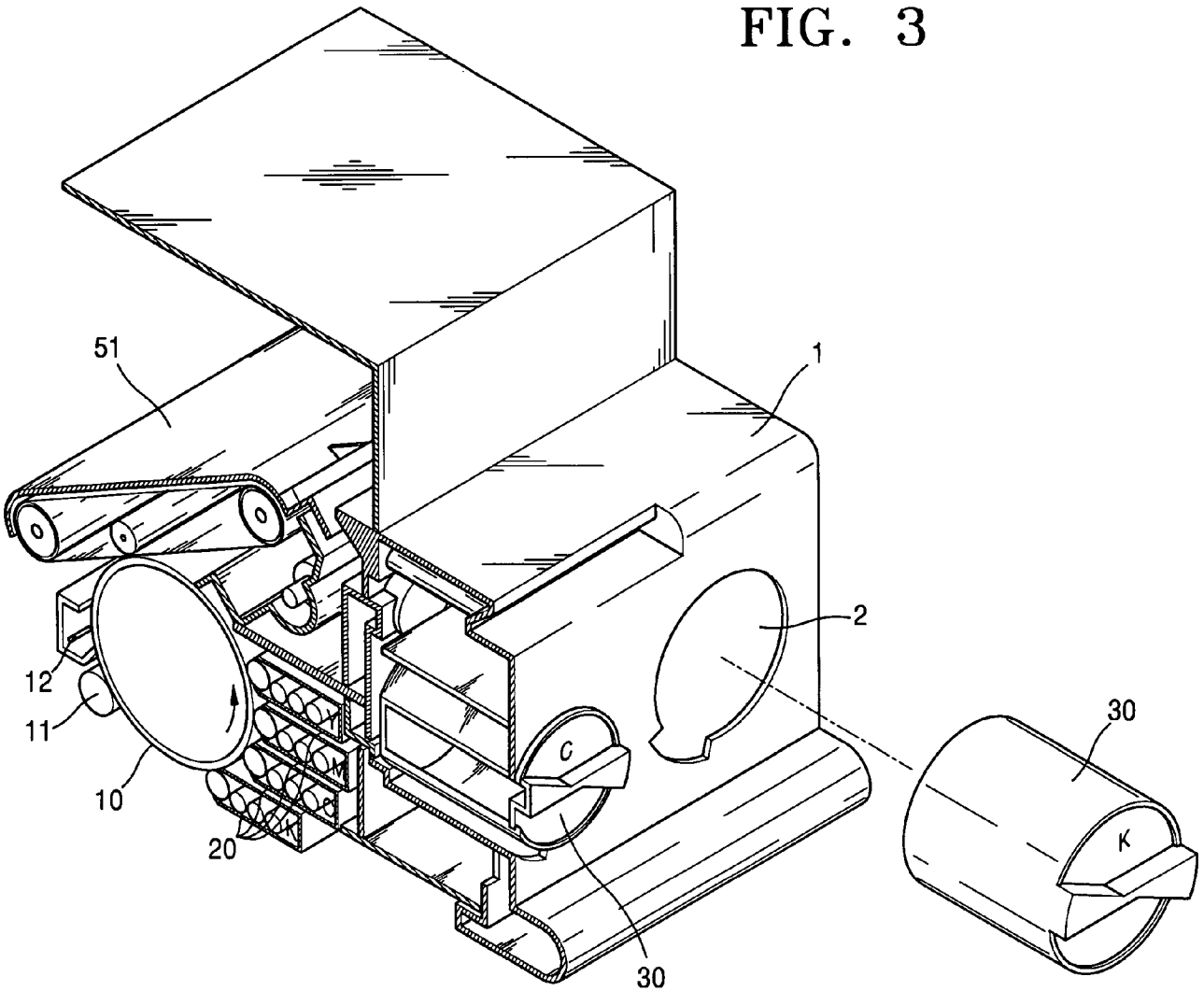
FIG. 3 is a perspective view illustrating the placement of a toner cartridge into an image forming apparatus of the present invention.

Referring FIG. 3, a mounting hole 2 is formed on a main frame 1 so that the plurality of toner cartridges 30Y, 30M, 30C, and 30K can be inserted. Being inserted into or separated from the mounting hole 2, the plurality of toner cartridges 30Y, 30M, 30C, and 30K are respectively connected to the toner supply units 25 of the plurality of developing cartridges 20Y, 20M, 20C, and 20K. Toner supply apertures 26 are formed on the toner supply units 25.

Figure 4:
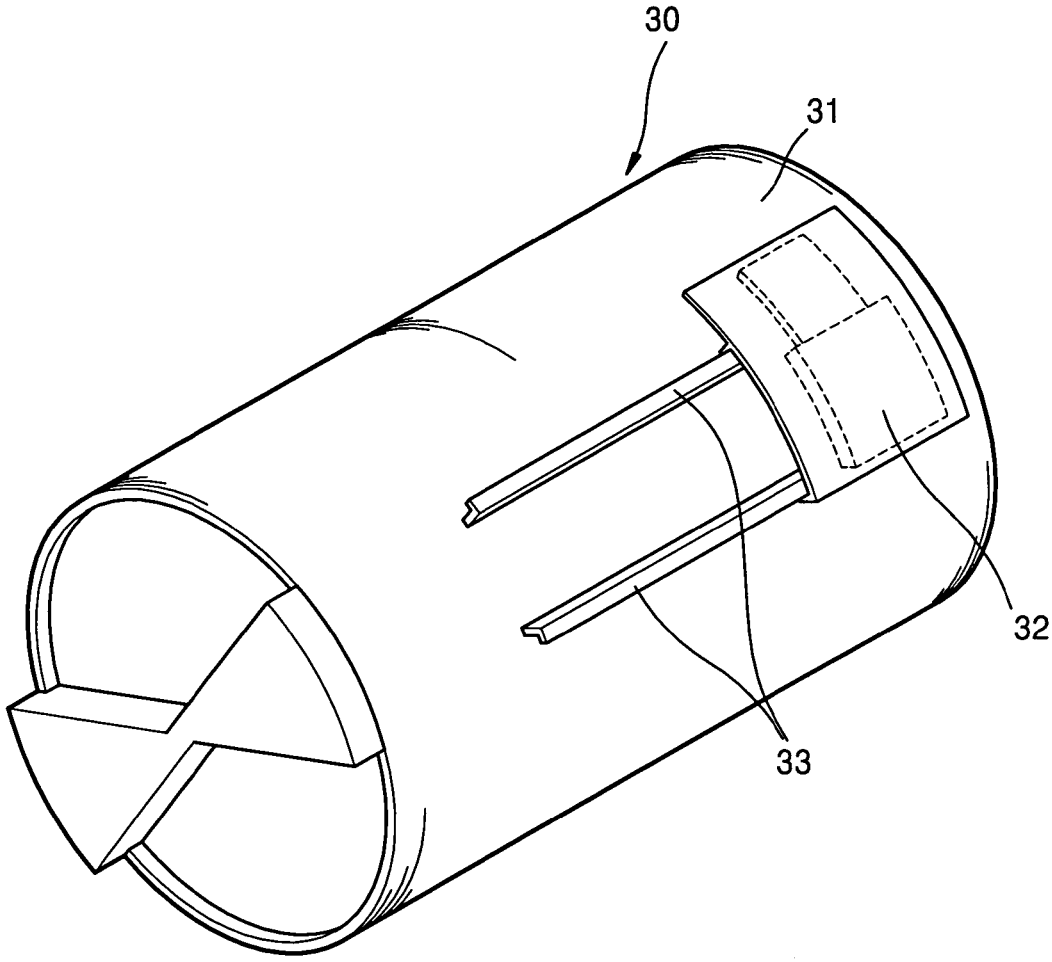
FIG. 4 is a perspective view of a toner cartridge according to the present invention.
Figure 5:
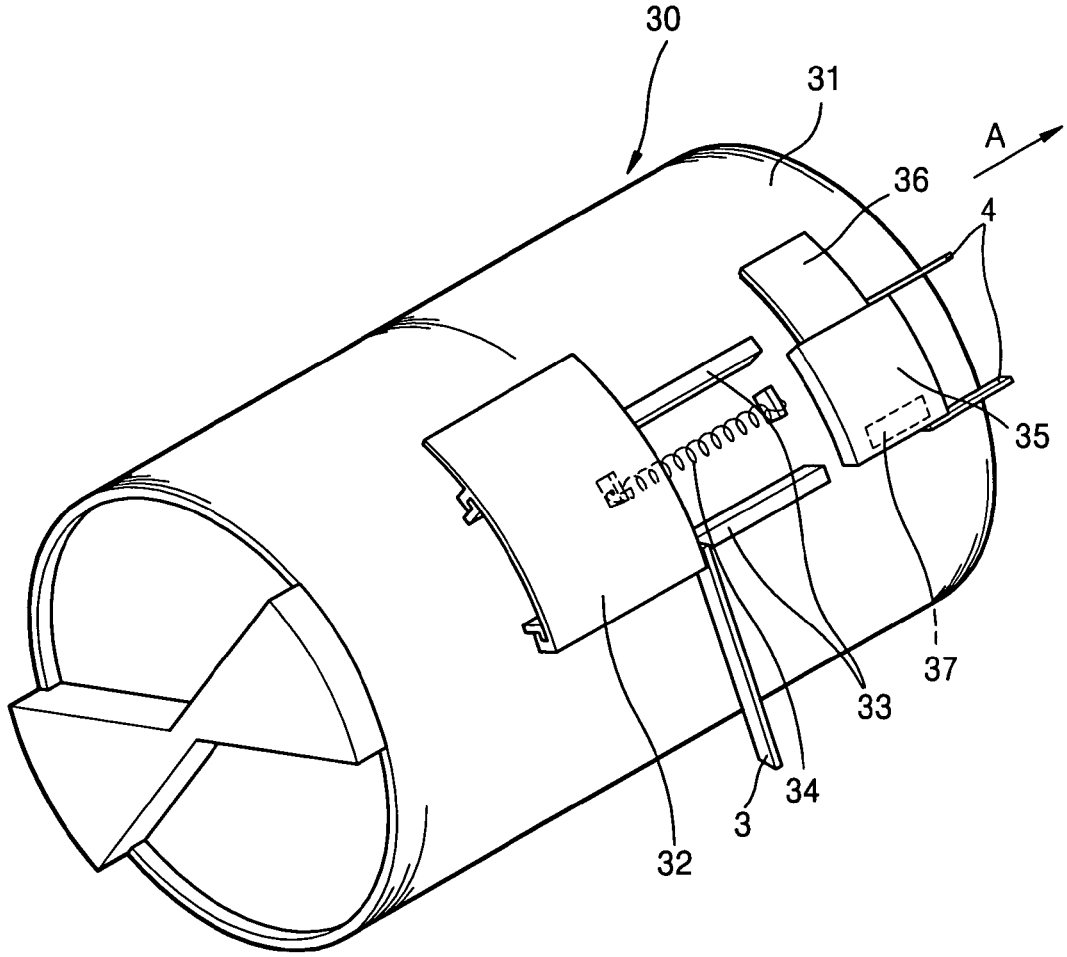
FIG. 5 is a perspective view illustrating an operation of a first shutter when the toner cartridge shown in FIG. 4 is placed into a developing cartridge.
Figure 6:
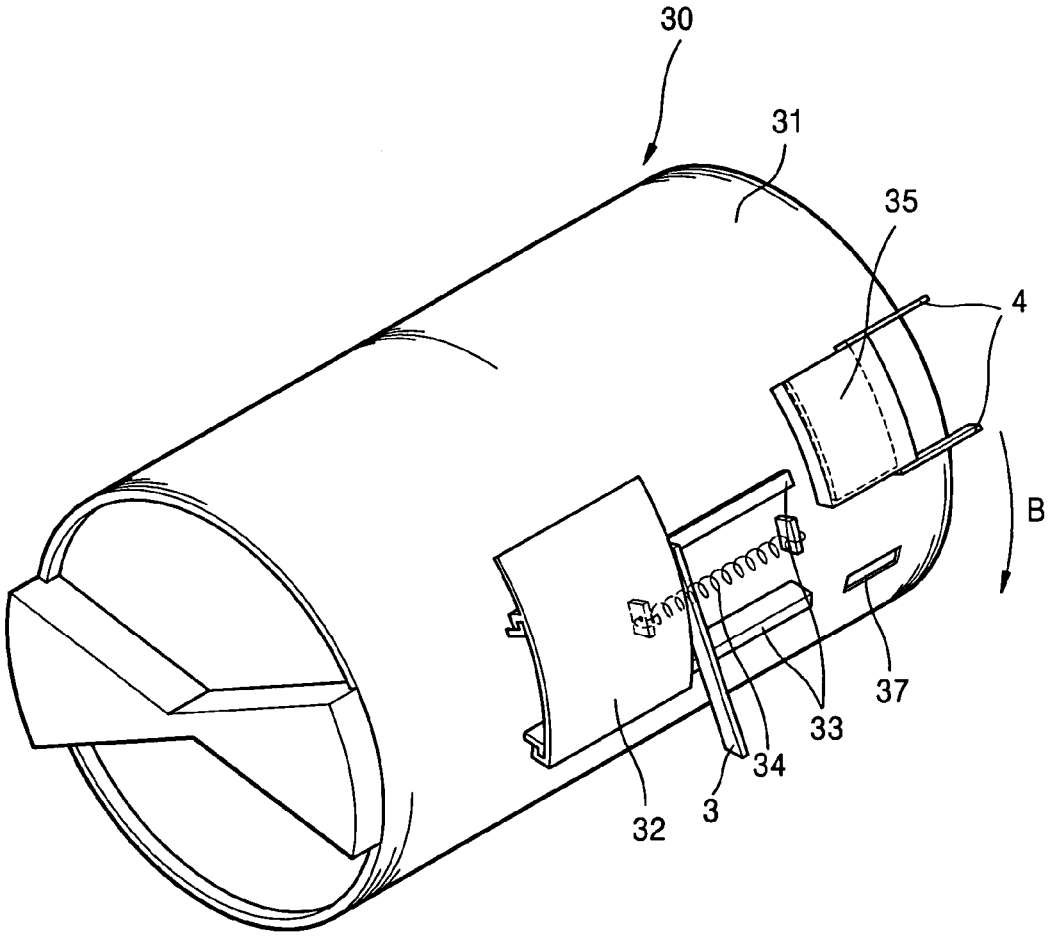
FIG. 6 is a perspective view illustrating an operation of a second shutter.

Referring FIGS. 4 through 6, each of the plurality of toner cartridges 30Y, 30M, 30C, and 30K includes a toner bottle 31, a first shutter 32, and a second shutter 35.

The toner bottle 31 for storing a toner is sealed air-tight, so that the toner does not leak to the outside. The toner bottle 31 has a substantially cylindrical side wall with a toner outlet at one end.

The first shutter 32 is disposed in the longitudinal direction of the toner bottle 31 with respect to a longitudinal axis and in a direction that the toner cartridges 30 are placed into the main frame 1, to isolate or expose the second shutter 35 from/to the outside. In the position shown in FIG. 4, first shutter 32 is in a closed position covering or overlying the second shutter 35.

The first shutter 32 slides along a first guide 33 provided to the toner bottle 31, and is under influence of the elastic force in a direction that isolates the second shutter 35 from the outside by an elastic member 34 such as a spring. The first guide 33 may be built into the toner bottle 31, or may be a separate member attached to the toner bottle 31. In the embodiment shown in FIG. 4, the guide member 32 is a pair of rails cooperating with the first shutter to enable the first shutter to slide in a linear direction.

When the toner cartridges 30 are placed into the developing cartridges 20, the first shutter 32 opens to expose the second shutter 35 to the outside. Also, when the toner cartridges 30 are separated from the developing cartridges 20, the first shutter 32 is returned to the original position to cover and isolate the second shutter 35 from the outside by the elastic member 34.

When the toner cartridges 30 are placed into the developing cartridges 20, the first shutter 32 contacts a first stop member 3 provided on the main frame 1 (see FIG. 6) to move the first shutter 32 with respect to the toner cartridge 30 to expose the second shutter 35. Hence, the movement of the first shutter 32 is interrupted by the first stop member 3 with respect to the developing cartridge, and only the toner bottle 31 moves, such that the second shutter 35 is exposed.

While sliding and rotating in the circumferential direction (perpendicular to a direction that the first shutter 32 slides) of the toner bottle 31, the second shutter 35 opens and closes a toner outlet 37 provided to the toner bottle 31. Before the toner cartridges 30 are placed into the developing cartridges 20, the second shutter 35 is hidden by the first shutter 32, and when the toner cartridges 30 are placed into the developing cartridges 20, the second shutter 35 is exposed as the first shutter 32 slides with respect to the toner cartridge.

The second shutter 35 slides along a second guide 36 provided on the toner bottle 31, to open and close the toner outlet 37. The second guide 36 may be built into the toner bottle 31, or may be a separate member attached to the toner bottle 31.

After the toner cartridges 30 are placed into the developing cartridges 20, the second shutter 35 is inserted into a second stopper 4 provided to the main frame 1 (see FIGS. 5-6). When the toner bottle 31 rotates, the movement of the second shutter 35 is prevented so that rotation of the toner bottle 31 causes a relative sliding movement of the second shutter 35 with respect to the toner bottle 31 to open the toner outlet 37.

Figure 7:
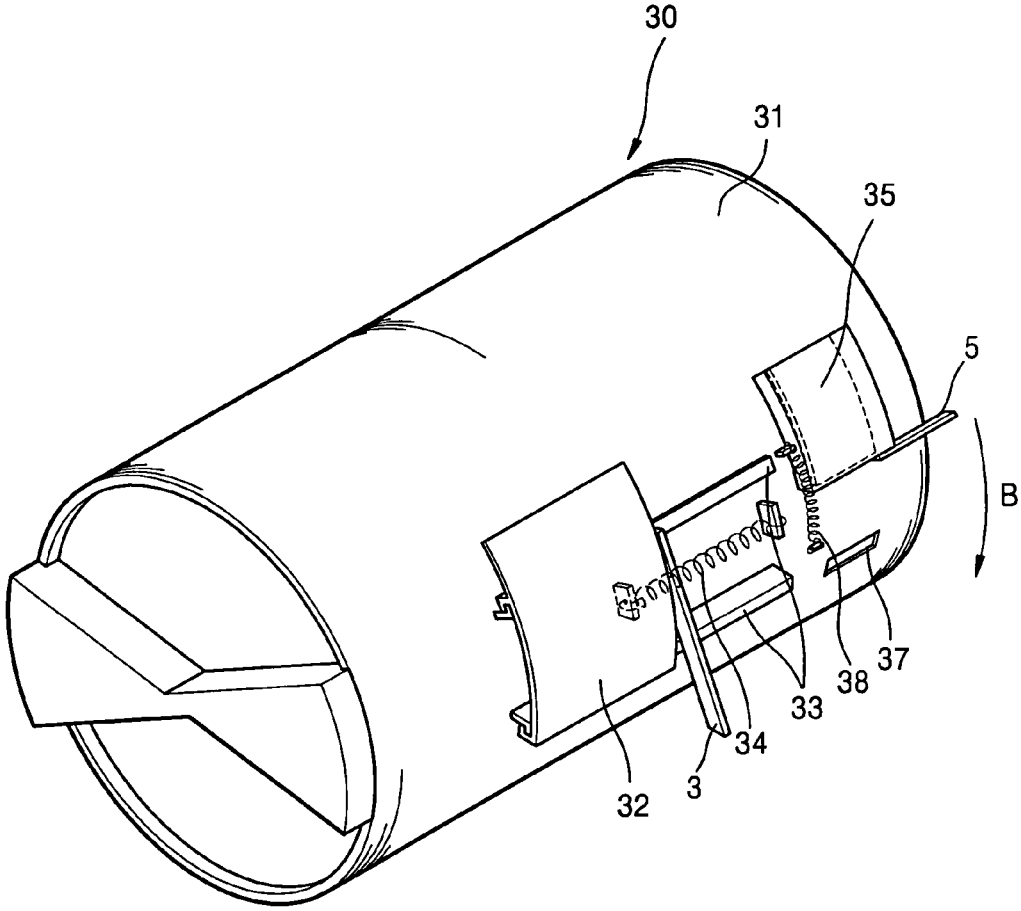
FIG. 7 is a perspective view of a toner cartridge according to a second embodiment of the present invention.

Referring to FIG. 7, the toner cartridge 30 according to a second embodiment of the present invention has the same structure as in the first embodiment shown in FIG. 6, except for the structure of the second shutter 35.

In the first embodiment of the present invention, the second shutter 35 is configured to be inserted into the second stop member 4. In the second embodiment of the present invention, the second shutter 35 is configured such that one side thereof contacts a third stop member 5 and is under influence of the elastic force in a direction to isolate the toner outlet 37 from the outside.

Hence, when the toner bottle 31 rotates, the movement of the second shutter 35 is prevented by the third stop member 5, so that the toner outlet 37 of the toner bottle 31 is exposed to the outside. Here, the second shutter 35 is under the influence of the elastic force in the direction that isolates the toner outlet 37 from outside by the elastic member 38. When the toner bottle 31 rotates in the opposition direction, the second shutter 35 returns to the original position by the elastic force to isolate the toner outlet 37.

The opening and closing operations of a double shutter of the toner cartridges 30 according to the prevent invention will be described with reference to the accompanying drawings.

First, an opening operation of the double shutter when the toner cartridges 30 are placed into the developing cartridges 20 will be described. Here, the double shutter includes the first shutter 32 and the second shutter 35.

Referring to FIG. 5, when the toner cartridges 30 are placed into the mounting hole 2 (see FIG. 3), the first shutter 32 contacts the first stopper 3 on the main frame 1 (see FIG. 3).

As the toner cartridges 30 are further pushed into the mounting hole 2, the toner bottle 31 moves in an arrow A direction of FIG. 5. The first shutter 32 cannot move because it is restrained by the first stop member 3, so that the first shutter 32 slides relative to the toner bottle 31 and exposes the second shutter 35. The elastic force is applied to the first shutter 32 by the elastic member 34 in a direction that closes the second shutter 35.

After the toner cartridges 30 are inserted into the mounting hole 2, the second shutter 35 is inserted into the second stopper 4 on the main frame 1 (see FIG. 3)

Next, as shown in FIG. 6, when the toner bottle 31 rotates in the direction of arrow B, the second shutter 35 contacts the second stop member 4 and does not rotate with the toner bottle 31.

As a result, the second shutter 35 rotates relative to the toner bottle 31 and opens the toner outlet 37. When the toner bottle 31 rotates, the toner outlet 37 is connected to the toner supply aperture 26, while facing the developing cartridges 20.

Next, a closing operation of the double shutter will be described.

In the closing operation of the double shutter, the above-mentioned opening operation of the double shutter is carried out in a reverse order. Namely, the toner bottle 31 rotates in a reverse direction of the arrow B, and then is separated from the mounting hole 2 (see FIG. 3) in a reverse direction of the arrow A.

Being inserted into the second stop member 4, the second shutter 35 is not movable relative to the toner bottle 31 so that as the toner bottle 31 rotates in the reverse direction of the arrow B, the toner outlet 37 closes.

Since the first shutter 32 is under the influence of the elastic force by the elastic member 34, when the toner cartridges 30 are separated from the mounting hole 2 (see FIG. 3), the first shutter 32 returns to the original position to cover the second shutter 35.

Figure 8:
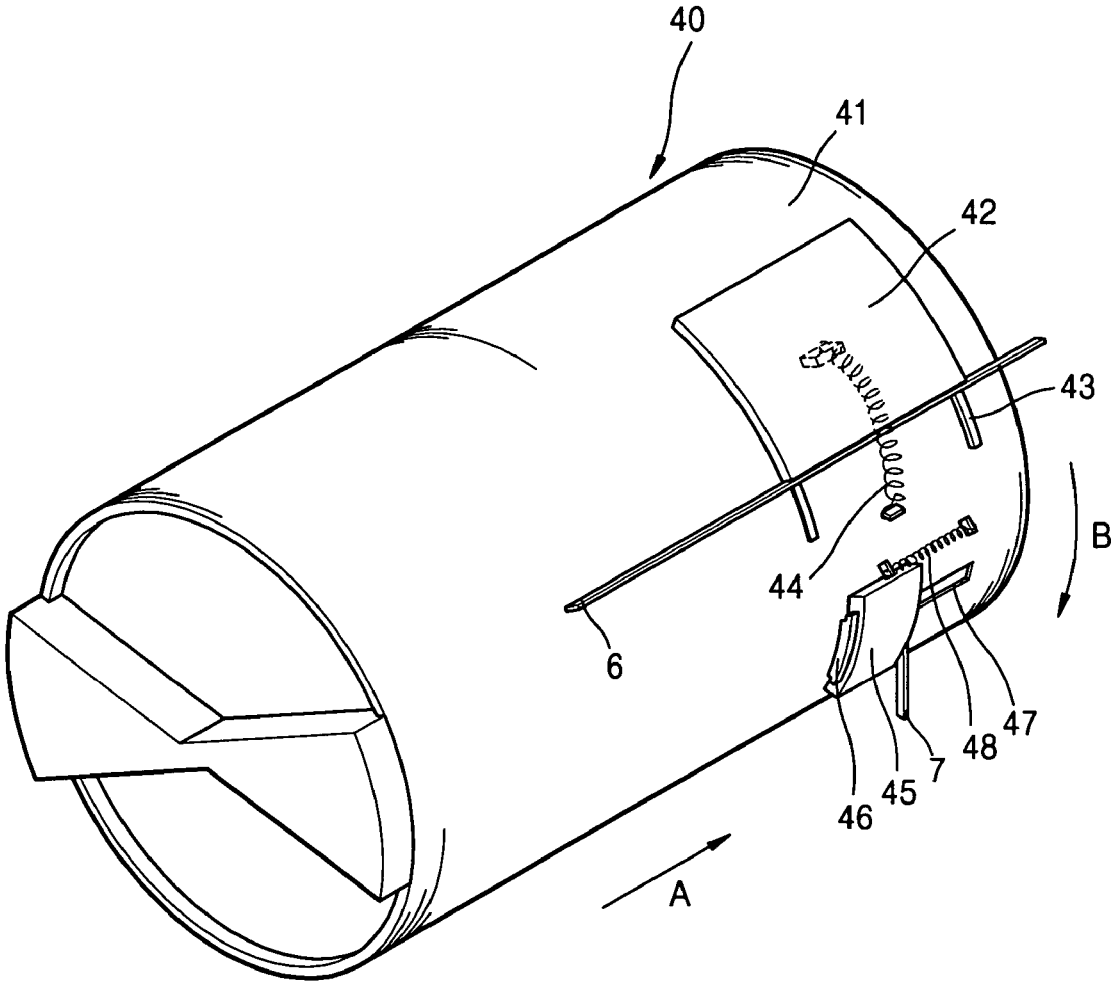
FIG. 8 is a perspective view of a toner cartridge according to a third embodiment of the present invention.

Referring to FIG. 8, a toner cartridge 40 according to a third embodiment of the present invention has the same structure as in the first embodiment shown in FIG. 4, except for the opening directions of a first shutter 42 and a second shutter 45.

The first shutter 42 is disposed to open and close in the circumferential direction of a toner bottle 41, and the second shutter 45 is disposed to open in the longitudinal direction of the toner bottle 41.

Thus, while the toner cartridge 40 is placed into the main frame 1, if the toner cartridge 40 rotates in the arrow B direction with respect to the main frame 1, the first shutter 42 contacts a fourth stop member 6 on the main frame 1 and slides to expose the second shutter 45 to the outside. In addition, when the toner cartridge 40 is pushed into the main frame 1, the second shutter 45 contacts a fifth stop member 7 on the main frame 1 and slides to open a toner outlet 47. Here, the first shutter 42 remains in contact with the fourth stop member 6 while the toner cartridge slides.

The first shutter 42 is under the influence of the elastic force in a direction that isolates the second shutter 45 from the outside by an elastic member 44. The second shutter 45 is under the influence of the elastic force in a direction that isolates the toner outlet 47 from the outside.

Accordingly, the toner cartridge according to the present invention includes a double shutter so that leakage of toner stored in the toner cartridge can be prevented, thereby enhancing the reliability of an image quality is improved, and a user's convenience in a use thereof. These benefits are also by use of the toner cartridge in an electrophotographic imaging apparatus.

What is claimed is:

1. A toner cartridge comprising:

an air-tight toner bottle for storing a toner and having a longitudinal dimension and a toner outlet;

a first shutter sliding in the longitudinal direction of the toner bottle; and a second shutter sliding in a circumferential direction of the toner bottle to open and close the toner outlet;

wherein the first and second shutters form a double structure in which one of the first and second shutters covers the other.

2. The toner cartridge of claim 1, further comprising an elastic member coupled to the first shutter to bias the first shutter in a direction that covers the second shutter.

3. The toner cartridge of claim 1, wherein the second shutter is isolated from the outside by the first shutter, and is then exposed when the first shutter slides to a retracted position.

4. The toner cartridge of claim 1, further comprising an elastic member coupled to the second shutter to bias the second shutter to a closed position to close the toner outlet.

5. The toner cartridge of claim 1, wherein the toner bottle has a cylindrical shaped side wall and the toner outlet is formed in the side wall, a first guide member on the outer surface of the side wall and extending in the longitudinal direction, the first shutter coupled to the first guide member to slide between an open position and a closed position to expose the second shutter, and a second guide member on the outer surface of the side wall and extending in a circumferential direction, the second shutter coupled to the second guide member to slide between an open position and closed position to open the toner outlet.

6. An electrophotographic image forming apparatus having a plurality of toner cartridges and a plurality of developing cartridges for developing a photosensitive medium using toners respectively supplied by the plurality of toner cartridges wherein each of the toner cartridge comprises:

an air-tight toner bottle for storing a toner and having a longitudinal dimension and a toner outlet;

a first shutter sliding in the longitudinal direction of the toner bottle; and a second shutter sliding in a circumferential direction of the toner bottle so as to open and close the toner outlet;

wherein the first and second shutters form a double structure in which one of the first and second shutters covers the other.

7. The apparatus of claim 6, further comprising an elastic member coupled to the first shutter to bias the first shutter in a direction to cover the second shutter.

8. The apparatus of claim 6, wherein the second shutter is isolated from the outside by the first shutter, and is then exposed when the first shutter slides to a retracted position.

9. The apparatus of claim 8, wherein the second shutter is open and closed by rotating the toner bottle in the circumferential direction thereof with respect to the image forming apparatus.

10. The apparatus of claim 6, wherein the first shutter slides to expose the second shutter when the toner cartridges is placed into the developing cartridges.

11. The toner cartridge of claim 6, further comprising an elastic member coupled to the second shutter to bias the second shutter to a closed position to close the toner outlet.

12. The apparatus of claim 6, wherein the toner bottle has a cylindrical shaped side wall and where the toner outlet is formed in the side wall, a first guide member on the side wall and extending in the longitudinal direction of the side wall, the first shutter coupled to the first guide member to slide between a closed position covering a second shutter to an open position exposing the shutter member when the toner bottle is inserted longitudinally into the toner cartridge, and a second guide member on the outer surface of the toner bottle and extending in a circumferential direction, the second shutter coupled to the second guide member to slide between an open position and closed position to open the toner outlet when the toner bottle is rotated with respect to the toner cartridge.

13. A toner cartridge comprising:

an air-tight toner bottle for storing a toner and having a longitudinal dimension and a toner outlet;

a first shutter sliding in the circumferential direction of the toner bottle; and a second shutter sliding in a longitudinal direction of the toner bottle to open and close the toner outlet;

wherein the first and second shutters form a double structure in which one of the first and second shutters covers the other.

14. An electrophotographic image forming apparatus having a plurality of toner cartridges and a plurality of developing cartridges for developing a photosensitive medium using toners respectively supplied by the plurality of toner cartridges wherein each of the toner cartridge comprises:

an air-tight toner bottle for storing a toner and having a longitudinal dimension and a toner outlet;

a first shutter sliding in the circumferential direction of the toner bottle; and a second shutter sliding in a longitudinal direction of the toner bottle so as to open and close the toner outlet;

wherein the first and second shutters form a double structure in which one of the first and second shutters covers the other.

15. The toner cartridge of claim 1, wherein the first shutter slides between a first position and a second position; and where the second shutter is prevented from sliding when the first shutter is in the first position, and the second shutter slides to open the toner outlet when the first shutter is in the second position.

16. The electrophotographic image forming apparatus of claim 6, wherein the first shutter slides between a first position and second position, and where the second shutter is prevented from sliding when the first shutter is in the first position and the second shutter slides to open the toner outlet when the first shutter is in the second position.

17. The toner cartridge of claim 13, wherein the first shutter slides between a first position and a second position, and where the second shutter is prevented from sliding when the first shutter is in the first position and the second shutter slides to open the toner outlet when the first shutter is in the second position.

18. The toner cartridge of claim 13, wherein the first shutter covers the second shutter when the second shutter closes the toner outlet.

19. The electrophotographic image forming apparatus of claim 14, wherein the first shutter slides between a first position and second position, and where the second shutter is prevented from sliding when the first shutter is in the first position and the second shutter slides to open the toner outlet when the first shutter is in the second position.

20. The electrophotographic image forming apparatus of claim 14, wherein the first shutter covers the second shutter when the second shutter closes the toner outlet.

* * * * *